United States Patent [19]

Kontos

[11] 4,399,828

[45] Aug. 23, 1983

[54] METHODS AND APPARATUS FOR TREATING WORK PIECES

[76] Inventor: Nicholas G. Kontos, 635 Melwood NE., Warren, Ohio 44483

[21] Appl. No.: 316,079

[22] Filed: Oct. 29, 1981

[51] Int. Cl.[3] ..... B08B 3/06; B05C 3/08; C25D 17/20

[52] U.S. Cl. ..... 134/65; 134/134; 118/418; 204/213

[58] Field of Search ..... 204/198, 199, 200, 201, 204/202, 203; 118/418; 427/242; 134/134, 65, 69, 159, 122 R, 122 P

[56] References Cited

U.S. PATENT DOCUMENTS

| | | | |
|---|---|---|---|
| 784,034 | 3/1905 | Clough | 204/201 |
| 941,535 | 11/1909 | Pottahoff | 204/200 |
| 1,422,309 | 7/1922 | Schweinsbergh et al. | 134/134 |
| 1,510,504 | 10/1924 | Schweinsbergh et al. | 134/134 |
| 2,037,264 | 4/1936 | Pothoff | 204/200 |
| 3,282,819 | 11/1966 | Hovanic | 204/201 |
| 3,846,271 | 11/1974 | Singleton | 204/213 |
| 3,855,107 | 12/1974 | McInnes | 204/213 X |
| 4,062,752 | 12/1977 | Peterson | 204/213 |

FOREIGN PATENT DOCUMENTS

| | | | |
|---|---|---|---|
| 381706 | 7/1973 | U.S.S.R. | 204/201 |

*Primary Examiner*—G. L. Kaplan
*Assistant Examiner*—Nam X. Nguyen
*Attorney, Agent, or Firm*—Michael Williams

[57] ABSTRACT

The invention relates to methods and apparatus for treating work pieces, and particularly to electroplating small metal articles such as nuts, bolts, arms, hangers and the like. The apparatus, with little variation, could also be used for cleaning, pickling, tumbling, blackening, dying, etc. The apparatus comprises a plurality of horizontally disposed cylinders, each having an inlet and an outlet, with the outlet of the first cylinder in communication with the inlet of a succeeding cylinder. The cylinders are rotatable about their axes in opposite directions and each has a spiral rib in the body thereof pitched in a certain direction, and a spiral rib in the outlet also pitched in said certain direction. Each cylinder also has a spiral rib in its inlet and this spiral is pitched in a direction opposite to that of the ribs in the cylinder body and the outlet thereof. When the first cylinder in the series of cylinders is rotated in a predetermined direction, workpieces fed to its inlet will be pushed by the spiral rib in said inlet to move into the cylinder body. With the first cylinder rotating in said predetermined direction, work pieces within the cylinder body are pushed toward the inlet end thereof by the spiral rib therein. When the first cylinder is rotated in an opposite direction, the spiral rib therein pushes the work pieces toward the cylinder outlet and the spiral rib in the latter will push the work pieces outwardly thereof and into the inlet of a succeeding cylinder, and the process will be continued by coordinating the rotation of the succeeding cylinders. This method of transfer of the work pieces provides a basis for a fully automated processing line.

8 Claims, 6 Drawing Figures

| | CAUSTIC CLEAN | CAUSTIC RINSE | ACID CLEAN | ACID RINSE | PLATER NO. 1 | PLATER NO. 2 | PLATER NO. 3 |
|---|---|---|---|---|---|---|---|
| 0.00 | + | O | + | O | + | + | + |
| 0.30 | + | O | + | O | + | + | + |
| 1.00 | + | O | + | O | + | + | + |
| 1.30 | + | O | + | O | + | + | + |
| 2.00 | + | O | + | O | + | + | + |
| 2.30 | + | O | + | O | + | + | + |
| 3.00 | + | O | + | O | + | + | + |
| 3.30 | + | O | + | O | + | + | + |
| 4.00 | + | O | + | O | + | + | + |
| 4.30 | + | O | + | O | + | + | + |
| 5.00 | + | O | + | O | + | + | + |
| 5.30 | + | O | + | O | + | + | + |
| 6.00 | + | O | + | O | + | + | + |
| 6.30 | + | O | + | O | + | + | + |
| 7.00 | + | O | + | O | + | + | + |
| 7.30 | + | O | + | O | + | + | + |
| 8.00 | + | O | + | O | + | + | + |
| 8.30 | + | O | + | O | + | + | O |
| 9.00 | + | O | + | O | + | O | + |
| 9.30 | O | + | O | + | O | + | + |
| 10.00 | + | O | + | O | + | + | + |

+ = LOAD & PROCESS O= UNLOAD

METHODS AND APPARATUS FOR TREATING WORK PIECES

BACKGROUND AND SUMMARY

The prior art includes cylinders for plating and other uses, wherein a spiral rib is utilized to push work pieces from an inlet to an outlet. Also known in the prior art is rotation of a cylinder in opposite directions, with the work pieces being plated in one direction of rotation, and the work pieces caught in a side pocket of the cylinder when the latter rotated in an opposite direction for discharge through a door.

However, the prior art fails to disclose a plurality of serially disposed cylinders, with the outlet of one communicating with the inlet of a succeeding one, in combination with spiral ribs adapted to feed work pieces into a cylinder and hold them there for treatment when the cylinder is rotated in one direction, and further adapted to discharge the work pieces from said cylinder and through the outlet thereof and into the inlet of a succeeding cylinder when the first named cylinder is rotated in an opposite direction.

DESCRIPTION OF THE DRAWINGS

In the drawings accompanying this specification and forming a part of this application, there is shown, for purpose of illustration, an embodiment which my invention may assume, and in these drawings.

DESCRIPTION OF A PREFERRED EMBODIMENT

Figure 1:
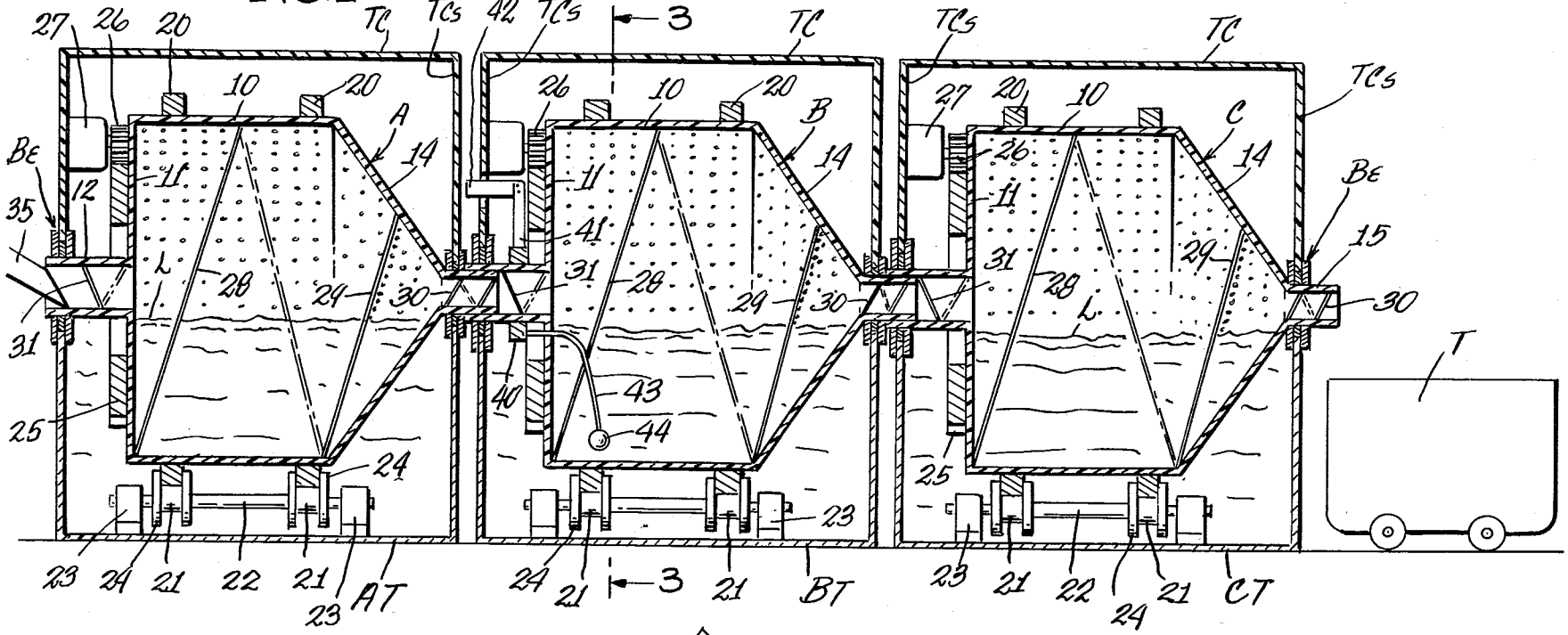
FIG. 1 is a longitudinal section through three serially arranged cylinders to illustrate a preferred embodiment of my invention, FIG. 2 discloses enlarged, perspective views of parts utilized in the construction of FIG. 1.
Figure 3:
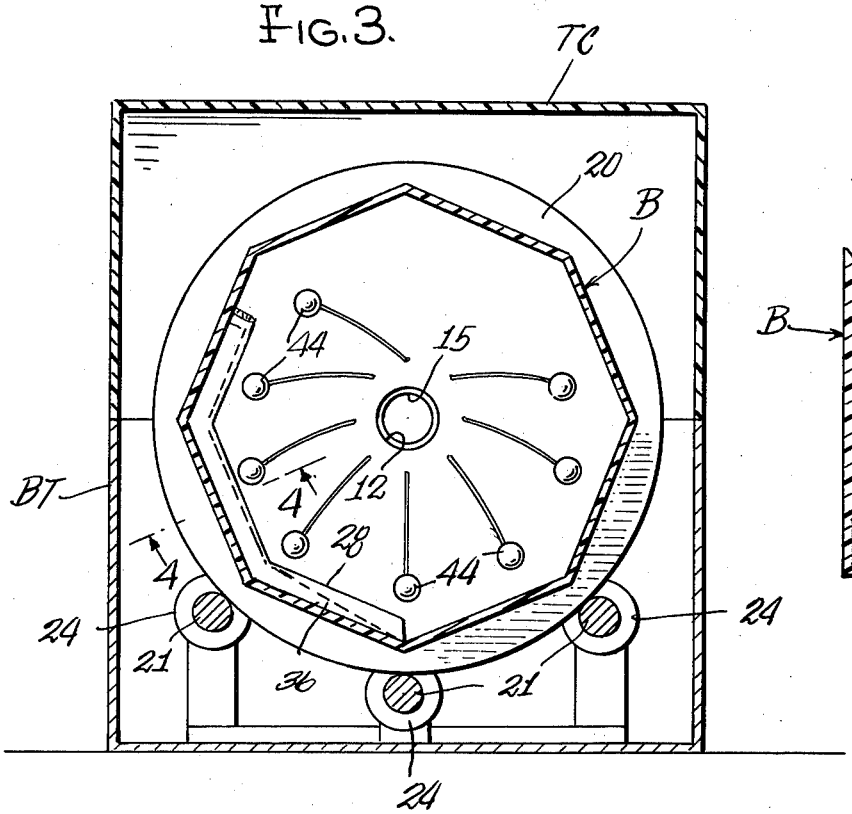
FIG. 3 is transverse section corresponding to the line 3—3 of FIG. 1.

In FIG. 1 three cylinders A, B and C are axially aligned with the outlet of a forward one in communication with the inlet of a succeeding one. The cylinders are preferably formed of a suitable stress-relieved polypropylene, and are pretty much alike. Each cylinder comprises a drum or body portion 10 of a relatively large transverse size (6 to 8 feet in diameter, for example) to accommodate a large number of work pieces for treatment. Preferably, each cylinder is octagonal in cross section, as shown in FIG. 3, in order to effect a good tumbling action of the work pieces. Each cylinder has a transverse forward wall 11 which is preferably flat and at right angles to the rotative axis of the cylinder. The forward wall has a central opening formed by a tubular extension 12 which forms the inlet to the cylinder. This extension may be octagonal or circular in transverse cross section.

Each cylinder has a rear cone-shaped wall 14 that is perforated, as is the main portion of the cylinder. The cone-shaped wall 14 terminates in a central, tubular outward extension 15 which forms the outlet of the cylinder. This extension may also be octagonal or circular in cross section.

Figure 2:
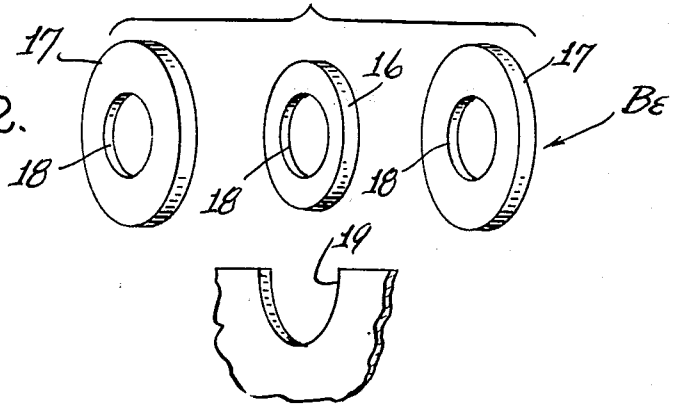

The cylinders A, B and C are mounted for rotation within respective liquid-containing steel tanks AT, BT and CT, and the perforations of the cylinder walls permit liquid from the tank to enter the cylinder. As seen in FIGS. 1 and 2, sandwich bearings Be are provided to at least partially support each cylinder. The bearings come in two sets, one set for the larger diameter inlet extensions 12 and the other set for the smaller diameter outlet extensions 15. In each case, the bearings are preferably formed of a good wearing plastic material and include a smaller diameter center disc 16 and two larger diameter discs 17. All three discs have a central opening 18 of the same size, to closely fit around the respective inlet or outlet of the cylinder. The discs 16 and 17—17 are secured together flatwise by cementing, riveting or the like to form a bearing unit Be which is disposed around a cylinder inlet or outlet.

The opposite end margins of the tank walls have semicircular grooves 19 (see FIG. 2), the groove in one wall being larger than that in the other wall to accommodate the size of the disc 16 for inlet or outlet extensions. The disc 16 has a bearing fit within the tank wall groove 19 to support the cylinder for rotation. The side discs 17—17 slidably bear against opposite side walls of the tank adjacent to the groove 19, to maintain the cylinder against undue axial movement.

In the event the sandwich bearings Be are insufficient to maintain the weight of the cylinder and the load of work pieces therein, a roller support may be included. As seen in FIG. 1, each cylinder A, B and C has a pair of circular tracks 20—20 fixed to its periphery, these tracks engaging rollers 21 on a shaft 22 which is rotatable in bearings 23 supported from the bottom wall of the tank. The rollers 21 form a cradle support for the cylinder, as seen in FIG. 3, and have side flanges 24 to maintain the cylinders against excessive axial movement.

Secured to and outwardly of the forward wall of each cylinder is a ring gear 25 which meshes with a pinion 26 fixed to the shaft of an electric motor 27 of the reversing type. Within each cylinder is a rib 28 of a high angle and pitched to push work pieces in a direction toward the outlet 15 when the cylinder is rotated in a clockwise direction. A similar spiralled rib 29 is located on the inside of the cone-shaped wall 14 and a spiralled rib 30 is located on the inner peripheral surface of the outlet 15, the ribs 29 and 30 being pitched in the same direction as the rib 28. A spiralled rib 31 is located on the inner peripheral surface of the inlet 12 and is pitched in a direction opposite to that of the ribs 28, 29 and 30.

Figure 4:
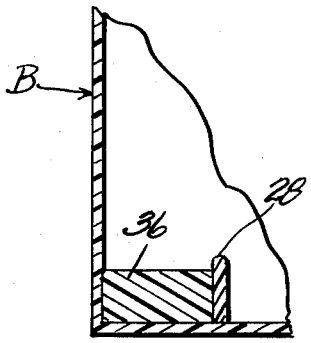
FIG. 4 is an enlarged, fragmentary sectional view corresponding to the line 4—4 of FIG. 3.

In operation of the apparatus thus far described, and assuming all cylinders are empty, work pieces are delivered to the inlet 12 of the first cylinder A by a chute 35, or in any other suitable manner, and this cylinder is rotated in a counterclockwise direction so that the rib 31 in the inlet 12 pushes the work pieces in a direction toward the interior of the cylinder, where they fall into the liquid in the cylinder and tend to gravitate to the bottom of the cylinder. The rib 28 in the cylinder will push the work pieces in a direction toward the forward wall 11. As seen in FIGS. 3 and 4, the first few portions of the rib 28 extending from the forward wall 11 have lands 36 which prevent work pieces from piling up behind the rib 28 at the foward wall and to thereby affect a fairly uniform distribution of such work pieces along the undermost inner peripheral surface of the rotating cylinder.

If the cylinder A is for a caustic clean or rinse, or an acid clean or rinse, or for any other liquid treatment, the tank AT is filled with the proper liquid to a level L which is just slightly below the semi-circular grooves 19 in the tank walls. Since the cylinder is perforated, the liquid will fill the cylinder to the level L and the work pieces will be thoroughly tumbled and treated by rotation of the cylinder in clockwise manner by the motor 27.

After the work pieces have been sufficiently treated in the cylinder A, rotation thereof in a clockwise direction is halted, the motor 27 is reversed and the cylinder is rotated in a counterclockwise direction. This will cause the spiral rib 28 to push the work pieces toward the cone-shaped cylinder wall 14, where the spiral rib 29 will pick up the work pieces and push them to the outlet 15, where the spiral rib 30 will push the work pieces outwardly of the cylinder A. The perforations in the cone-shaped wall will drain any liquid that is carried upwardly by the spiral rib 29, and preferably a larger amount of perforations are disposed along this rib.

As seen in FIG. 1, the outlet 15 of the cylinder A fits closely within the inlet 12 of the cylinder B and this latter cylinder is substantially similar to the cylinder A, the only change being the addition of means for performing an electroplating operation.

During the time the cylinder A is rotating in a counterclockwise direction to discharge work pieces therefrom, the cylinder B is rotated in a clockwise direction so that the spiral rib 31 in its inlet 12 will push the work pieces into the cylinder B to be acted upon by the rib 28 in the manner described in connection with the cylinder A.

The electroplating means comprises a ring 40 of copper or other electrical conductive material which is fixed around the exterior of the inlet 12 of the cylinder B. A conductive brush 41 or other suitable device has wiping contact with the ring and is carried by a bus bar 42 which is connected to a source of electrical energy. Flexible leads 43 are mechanically and electrically connected to the ring 40 in radially spaced relation and extend into the cylinder B for contact with the work pieces therein. These leads are commercially known as danglers and each may have a weighted conductive ball 44 to urge the lead in a downward direction. The construction provides for a sufficient number of danglers within the plating solution at all times.

When the plating operation is completed, rotation of the cylinder B is changed from clockwise to counterclockwise, and the work pieces are discharged from cylinder B into cylinder C in the manner before described. Cylinder C may contain a suitable rinse solution and this cylinder is rotated in clockwise manner to thoroughly treat the work pieces. When treatment is completed, cylinder C will be rotated in counterclockwise manner to discharge the work pieces into a truck T, or into any other desired apparatus.

The combination of cylinders A, B and C, arranged in serially connected manner as shown in FIG. 1, provide for an automated line for plating, cleaning, pickling, tumbling, blackening, dying or the like. Thus, the work pieces may be plated in cylinder B while other work pieces are treated in cylinders A and C. When the plated work pieces have been discharged from cylinder B, rotation of this cylinder is changed to clockwise manner to receive work pieces discharged from cylinder A. At the same time cylinder C may be rotated clockwise to treat the plated work pieces and then rotated counterclockwise to discharge the workpieces. A further cylinder, not shown, may be connected to the outlet of cylinder C wherein air, preferably heated, is blown over the tumbling work pieces, prior to discharge to the truck T. To avoid loss of fluid from a tank caused by splashing or otherwise, each tank may have a removable cover TC which may be made of the same material as the cylinders A, B and C, with an opening equal in transverse size to the top opening in a respective tank. Opposite side walls TCs of the cover may have semicircular openings therein, similar to the openings 19 in the tank walls, to fit the sandwich bearings Be in like manner. In some cases, such as where the solution in a tank must be kept cool, the covers need not be used.

Figure 5:
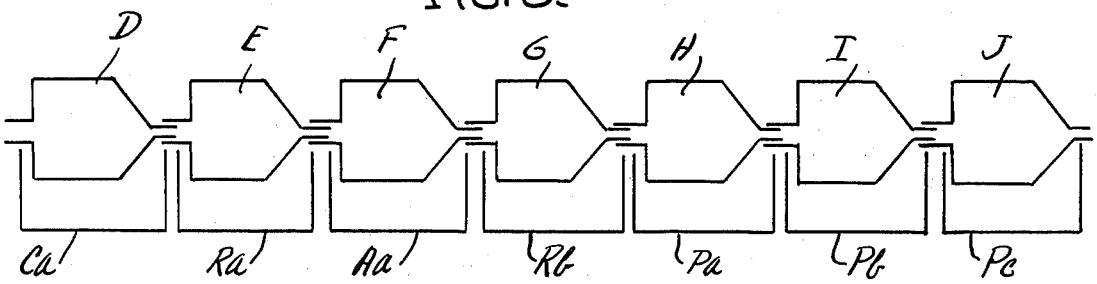
FIG. 5 is a schematic representation of a plurality of serially arranged cylinders for use in an automated plating system, together with a chart showing operating cycles.

FIG. 5 shows an arrangement of cylinders which may be used for a plating process, such as a zinc plating process. The plating cycle, disposed as an example, is 30 minutes. The cleaning and acid processes take only 10 minutes and therefore in FIG. 5 there are shown three plating tanks Pa, Pb and Pc to accumulate the needed 30 minutes of plating time. Also shown in FIG. 5 are one cleaning tank Ca and one acid tank Aa, and two rinse tanks Ra and Rb. Mounted within the tanks are rotatable cylinders D, E, F, G, H, I and J, the cylinders D, E, F and G being like the cylinders A and C, heretofore described, and the cylinders H, I and J being like the plating cylinder B heretofore described.

Accompanying FIG. 5 and forming a part thereof is a chart showing a 10-minute cycle in 30-second increments. The symbol "+" indicates a rotation of the cylinders in a clockwise direction so, as in the case of the cylinders A, B and C, to load and process work pieces. The symbol "o" indicates a counterclockwise rotation of the cylinders to discharge work pieces therefrom.

FIG. 5 shows the condition of the system just prior to the start of a ten-minute cycle, wherein the cylinders D, F, H, I and J contain and are processing work pieces, and the cylinders E and G are empty. Although it is not necessary to rotate the empty cylinders, it is preferable to have all cylinders rotating during the cycle. As seen in the chart accompanying FIG. 5, the work pieces are maintained and processed in tanks D, F, H, I and J for 8 minutes. At 8½ minutes, rotation of plating cylinder J is reversed to counterclockwise manner to discharge plated work pieces to the truck T, or to a post treatment which will be described later. At 9 minutes, the plating cylinder J is stopped and again rotated in clockwise direction to accept and process work pieces and plating cylinder I is stopped and then rotated in a counterclockwise manner to discharge its work pieces into cylinder J.

At 9½ minutes, plating cylinder I will stop and then be rotated in a clockwise direction to accept and process work pieces, and plating cylinder H stops and then is rotated in counterclockwise manner to discharge work pieces into cylinder I. At the same time, the two rinse cylinders E and G stop and then rotate in clockwise direction to respectively accept work pieces from the counterclockwise spinning cylinders D and F. At 10 minutes, the plating cylinder H stops and then rotates in clockwise manner to accept work from the discharging cylinder G, and cylinder F stops and then rotates clockwise to accept work from cylinder E, which is rotating counterclockwise to discharge work pieces. At 10 minutes, the cylinders are in the relation they are at the start of the 10-minute cycle. The cleaning cylinder D is in the position to accept work but being the first cylinder in the series, it must be loaded through a chute (such as the chute 35 hereinbefore described) by a workman or by suitable loading means.

Certain plating operations require that the work pieces remain in constant electrical contact with the danglers. In such operations, if contact is broken, such as by transfer from cylinder H to cylinder I, or from the latter cylinder to cylinder J, the work pieces develop a cloudy finish, or blisters or other undesirable finish. One logical and practical solution to this problem is to use only one plating cylinder. In addition, the diameter of such cylinder may be increased without necessarily increasing the length, so as to insure that the work is constantly submerged.

Figure 6:
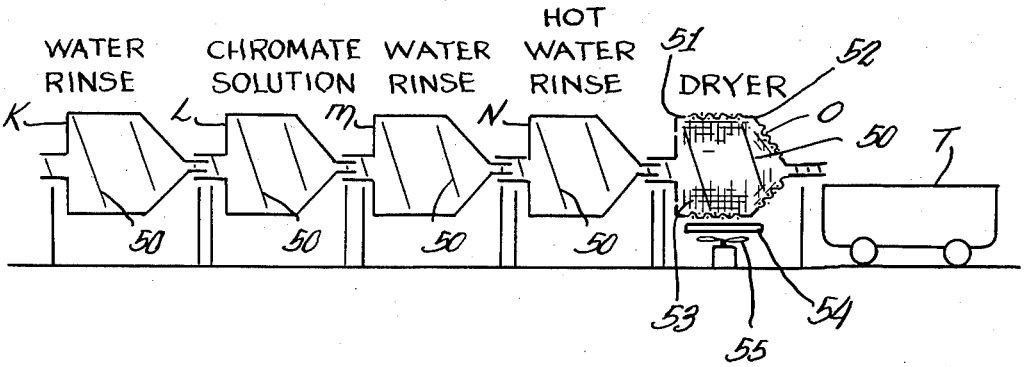
FIG. 6 is a schematic representation of a plurality of cylinders arranged for use in post treatment operations.

The post treatment of the work pieces (see FIG. 6), previously mentioned, will preferably consist of a cylinder K for a water rinse, a cylinder L for a chromate rinse, a cylinder M for a water rinse, a cylinder N for a hot water rinse and a cylinder O for drying the work pieces before they are delivered to a truck T. The cylinders K through O are serially arranged and, as before, the outlet of one communicates with the inlet of a succeeding one, and also, as before, at least the cylinder K through N are each rotatable within a tank which contains the solution. In some cases it may be desirable to insert a cylinder and tank (not shown) between cylinders K and L for a dilute nitric rinse.

The work pieces need only pass through the solutions in the tanks of cylinders K through N so therefore these cylinders, and cylinder O, will be driven to rotate only in one direction and the spiral ribs 50 in all cylinders, and in the inlets and outlets thereof, will all be pitched in the same direction. Thus, the work pieces will be admitted to cylinder K by means of a chute, or from the outlet of cylinder C, and immediately will be passed to the next cylinder in line. The speed at which the work passes through the various solutions may be varied by the speed of rotation of the cylinders.

The drying cylinder O may be of special design, with circular angle irons 51-52 defining a circular skelton over which a chain link sheet 53 is secured to provide a mesh basket. The cylinder O should be confined, probably within a tank like the others (but supported), and electric strip heaters 54 and a blower 55 are disposed to blow hot air over the work pieces as they pass through the cylinder O.

I claim:

1. Apparatus for bulk treatment of work pieces, comprising:

a cylinder mounted for rotation about its longitudinal axis, said axis being generally horizontally disposed, said cylinder having an axially arranged inlet in one end for receiving work pieces, and an axially arranged outlet in its opposite end through which work pieces are discharged, a spiral rib on the inner wall surface of said cylinder and of a length to extend substantially between said cylinder ends, said rib acting in the manner of a conveyor screw to push work pieces longitudinally of said cylinder, means for selectively rotating said cylinder in one direction or in a direction opposite to said one direction, means at said inlet for engaging work pieces delivered to said inlet and moving them therethrough and into said cylinder when the latter is rotating in said one direction, the angular hand of said spiral rib being correlated with cylinder rotation whereby said spiral rib is adapted to push the work pieces within said cylinder in a direction toward but not out of said inlet end of said cylinder when the latter is rotating in said one direction to effect good distribution of the work pieces longitudinally along the inner wall of said cylinder, and said spiral rib being adapted to push said work pieces within said cylinder in a direction toward said outlet end of said cylinder when the latter is rotated in said opposite direction.

2. The construction according to claim 1 wherein said cylinder comprises a main body portion, and a conical portion extending from said main body portion and forming said cylinder opposite end, said inlet comprising a tubular portion disposed outwardly of said cylinder and extending axially in a direction away from said cylinder one end, and said outlet comprises a tubular portion in communication with and extending axially in a direction away from said conical portion, both said inlet and outlet tubular portions providing axial openings of a transverse size smaller than the transverse size of said cylinder main body portion.

3. The construction according to claim 2 wherein the mentioned spiral rib is located in said main body portion, and wherein the inner wall of said conical portion and the inner wall of said outlet tubular portion have spiral ribs cooperable with and having an angular hand the same as the rib in said main body portion, and cooperable therewith to push the work pieces toward and outwardly of said outlet when said cylinder is rotated in said opposite direction.

4. The construction according to claim 3 wherein the inner wall surface of said inlet tubular portion is provided with a spiral rib which is of an angular hand opposite to that of the ribs in said cylinder main body portion, said conical portion and said outlet tubular portion, and adapted to push work pieces therethrough and into said cylinder main body portion when said cylinder is rotated in said one direction.

5. The construction according to claim 4 wherein a plurality of said cylinders are arranged in axial alignment, with the outlet of one adapted to feed work pieces into the inlet of another.

6. The construction according to claim 5 wherein the transverse size of said outlet tubular portion of each cylinder is smaller than the transverse size of the opening in said inlet tubular portion, said outlet portion closely fitting within said inlet portion by permitting relative rotation of said aligned cylinders.

7. Apparatus for bulk treatment of work pieces, comprising:

first and second similar cylinders, each for receiving work pieces to be treated and each mounted for independent rotation about its horizontally disposed axis, each cylinder having inlet and outlet openings at its opposite longitudinal ends, each having a spiral rib on the inner wall surface thereof and of a length to extend substantially between said cylinder ends, each rib acting in the manner of a conveyor screw to push work pieces longitudinally of said cylinder when the latter is rotated, the outlet of said first cylinder comprising a cylindrical extension of less diameter than said cylinder and the inlet of said second cylinder comprising a cylindrical extension of less diameter than said cylinder, said inlet and outlet cylindrical extensions being correlated so that one is adapted to fit within the other to establish a work piece flow path between said cylinders but permit relative rotation thereof, means for independently rotating each cylinder in one direction or in a direction opposite to said one direction, rotation of a cylinder in said one direction causing said rib to push the work pieces therein in a direction toward but not out of its inlet end to effect substantially even distribution of the work pieces along the inner wall surface of said cylinder, and rotation of the same cylinder in said opposite direction causing its rib to push the work pieces therein in a direction toward and outwardly of said outlet, said cylinders being consecutively arranged in juxtaposition with their longitudinal axes in horizontal alignment and said outlet and inlet cylindrical portions fitting one within the other whereby work pieces fed into the inlet of said first cylinder while the latter is rotating in said one direction effecting processing of the work pieces, and subsequent rotation of said first cylinder in said opposite direction effecting feeding of the work pieces along said flow path and into said second cylinder while the latter is being rotated in said one direction to thereby process the work pieces in said second cylinder, rotation of said second in said opposite direction effecting feeding of the work pieces through and outwardly of its outlet.

8. The construction according to claim 7 wherein seven cylinders are arranged in the manner claimed, with the outlet of the first in communication with the inlet of the second and the outlet of the subsequent cylinders in communication with the inlet of the consecutively following cylinder, and the outlet of the seventh cylinder discharging to a collection point for the work pieces, each cylinder having perforated walls and being arranged in a separate liquid bath, the first two cylinders being for caustic clean and caustic rinse, the third and fourth cylinders being for acid clean and acid rinse, and the fifth, sixth and seventh cylinders being for consecutive electroplating operations, and means for independently rotating said cylinders so that one feeds into a subsequent one.

* * * * *